US011835222B2

(12) United States Patent
Martinez Weber

(10) Patent No.: US 11,835,222 B2
(45) Date of Patent: Dec. 5, 2023

(54) OPTICAL DEVICE AND LUMINAIRE COMPRISING SAID OPTICAL DEVICE

(71) Applicant: ANTARES ILUMINACIÓN, S.A.U., Valencia (ES)

(72) Inventor: Federico Martinez Weber, Valencia (ES)

(73) Assignee: ANTARES ILUMINACION, S.A.U., Valencia (ES)

( * ) Notice: Subject to any disclaimer, the term of this patent is extended or adjusted under 35 U.S.C. 154(b) by 0 days.

(21) Appl. No.: 17/785,306

(22) PCT Filed: Apr. 2, 2020

(86) PCT No.: PCT/ES2020/070218
§ 371 (c)(1),
(2) Date: Jun. 14, 2022

(87) PCT Pub. No.: WO2021/198538
PCT Pub. Date: Oct. 7, 2021

(65) Prior Publication Data

US 2023/0056091 A1 Feb. 23, 2023

(51) Int. Cl.
*F21V 5/04* (2006.01)
*F21V 5/08* (2006.01)

(52) U.S. Cl.
CPC ..... *F21V 5/045* (2013.01); *F21V 5/08* (2013.01)

(58) Field of Classification Search
CPC ..... F21V 5/045; F21V 5/08
See application file for complete search history.

(56) References Cited

U.S. PATENT DOCUMENTS

| | | | | |
|---|---|---|---|---|
| 2009/0231855 | A1 | 9/2009 | Esakoff et al. | |
| 2015/0345742 | A1* | 12/2015 | Radl | F21V 5/08 362/327 |
| 2017/0002995 | A1* | 1/2017 | Yang | F21V 5/007 |
| 2019/0011110 | A1* | 1/2019 | Kim | F21V 7/0091 |
| 2019/0094557 | A1 | 3/2019 | Xu et al. | |
| 2019/0200537 | A1* | 7/2019 | Yahya | F21V 5/02 |
| 2019/0305180 | A1* | 10/2019 | Lee | F21V 5/045 |
| 2020/0079284 | A1 | 3/2020 | Chen et al. | |
| 2020/0400285 | A1* | 12/2020 | He | G02B 19/0061 |

FOREIGN PATENT DOCUMENTS

EP 2711615 A1 3/2014

* cited by examiner

*Primary Examiner* — Christopher E Dunay
(74) *Attorney, Agent, or Firm* — Hayes Soloway PC

(57) ABSTRACT

The present invention relates to an optical device comprising a light source that in turn emits a light beam, and that enables a predetermined area to be illuminated with a very high degree of uniformity in a plane perpendicular to said optical device, such that the orientation of the light beam is changed, illuminating only said predetermined area, where, due to the low profile thereof, the optical device enables same to be integrated into a luminaire with a reduced height dimension, which is also object of the present invention.

12 Claims, 5 Drawing Sheets

OPTICAL DEVICE AND LUMINAIRE COMPRISING SAID OPTICAL DEVICE

CROSS-REFERENCE TO RELATED APPLICATIONS AND PRIORITY

This patent application claims priority from PCT Application No. PCT/ES2020/070218 filed Apr. 2, 2020. Each of these patent applications are herein incorporated by reference in its entirety.

OBJECT OF THE INVENTION

The present invention relates to an optical device comprising a light source that in turn emits a light beam, and that enables a predetermined area to be illuminated with a very high degree of uniformity in a plane perpendicular to said optical device, such that the orientation of the light beam is changed, illuminating only said predetermined area.

Furthermore, due to the low profile thereof, the optical device enables same to be integrated into a luminaire with a reduced height dimension, which is also object of the present invention.

BACKGROUND OF THE INVENTION

Optical devices known as wall washers are known in the prior art, which enable a wall of a room to be illuminated when the optical device is placed on the ceiling of the same.

Said optical devices enable the light to be directed towards the wall, by means of a lens system that redirects the light beam at an angle of up to 90°. However, said optical devices are normally not capable of illuminating a predetermined area with a very high degree of uniformity, because the light is scattered.

Furthermore, said known optical devices illuminate part of the ceiling, which creates glare and does not enable the area to be illuminated to be clearly defined. Moreover, these devices of the state of the art do not enable the area to be illuminated to be clearly defined, due to the scattering of the light beam, failing to achieve the desired effect of illuminating a predetermined area.

These optical devices normally require the same to be integrated into high-profile luminaires, which are necessary to redirect the light beam in a direction essentially perpendicular to the emission direction of the light beam, which reduces the possibilities of integration in certain environments wherein the limitations associated with the available space prevent it from being placed.

For this reason, the light source must be placed very far from the light output area of the lighting device, making the necessary optical assembly very complex, resulting in a high cost of said lighting device.

The optical device and the luminaire of the present invention comprising said optical device solves all the previously described drawbacks.

DESCRIPTION OF THE INVENTION

The present invention relates to an optical device comprising a light source that in turn emits a light beam, and that enables a predetermined area to be illuminated with a very high degree of uniformity in a plane essentially perpendicular to said optical device, such that the orientation of the light beam is changed, illuminating only said predetermined area.

The optical device comprises

- at least one light source intended to radiate a light beam in a first direction that forms an angle less than 90° with an essentially vertical downward direction;
- a lens that in turn comprises:
  - a first total internal reflection (TIR) surface through which the light beam is reflected; and
  - a second faceted surface comprising at least one first step defining at least one first section and one second section of said second faceted surface, wherein the second faceted surface is configured to refract the light beam;
- wherein the second faceted surface forms at least an angle greater than 90° or the conjugate thereof with the essentially vertical downward direction;
- a shielding device defining therein an interior space wherein the lens is at least partially confined.

The optical device thus configured enables a predetermined area to be illuminated with a very high degree of uniformity in a plane perpendicular to said optical device, such that the orientation of the light beam is changed, illuminating only said predetermined area.

Optionally, the first total internal reflection surface and the second faceted surface are essentially confined in the interior space defined by the shielding device.

Optionally, the first section of the second faceted surface forms a first angle greater than 90° or the conjugate thereof with the essentially vertical downward direction, and the second section of the second faceted surface forms a second angle greater than 90° or the conjugate thereof with the essentially vertical downward direction, wherein the first angle is less than the second angle or the first angle is greater than the second angle in the case of the conjugates. Preferably, the first section is further from the at least one light source than the second section in the essentially vertical downward direction.

In this way, the light rays of the light beam that are refracted in the first section of the faceted surface, i.e., in an area further from the predetermined area to be illuminated, do so at a lower angle with the essentially vertical downward direction, such that they essentially illuminate an upper area of the predetermined area to be illuminated, while the light rays of the light beam that are refracted in the second section of the faceted surface, i.e., in an area closer to the predetermined area to be illuminated, do so at a greater angle with the essentially vertical downward direction, such that they essentially illuminate a lower area of the predetermined area to be illuminated. Thus, the light rays of the light beam that are refracted in the first section and the light rays of the light beam that are refracted in the second section cross each other, preventing the dispersion thereof and illumination in the predetermined area with a very high degree of uniformity, essentially in an intermediate area defined as the intersection of the upper area and the lower area.

Optionally, the shielding device has the shape of a truncated cylinder comprising a straight base and a surface of revolution, wherein the axis of the truncated cylinder is essentially parallel to the essentially vertical downward direction and wherein the straight base and the surface of revolution define the interior space defined by the shielding device.

The surface of revolution comprises an ellipse-shaped free edge, wherein a point of the ellipse arranged at a greater height in the essentially vertical downward direction is the point furthest from the predetermined area to be illuminated.

Optionally, the at least one light source and the lens can rotate about an axis essentially parallel to the essentially vertical downward direction, with respect to the shielding device, such that it is possible to orient said at least one light source and said lens with respect to the shielding device.

The invention also relates to a luminaire comprising at least one optical device of those described previously.

Optionally, the luminaire further comprises a housing wherein the at least one optical device is arranged, wherein the housing in turn defines the shielding device.

Preferably, the luminaire comprises a plurality of adjacently arranged optical devices, wherein the shielding devices of each of the optical devices are defined by the housing.

DESCRIPTION OF THE DRAWINGS

As a complement to the description provided herein, and for the purpose of helping to make the features of the invention more readily understandable, in accordance with a preferred practical exemplary embodiment thereof, said description is accompanied by a set of drawings constituting an integral part of the same, which by way of illustration and not limitation, represent the following.

PREFERRED EMBODIMENT OF THE INVENTION

Figure 1:
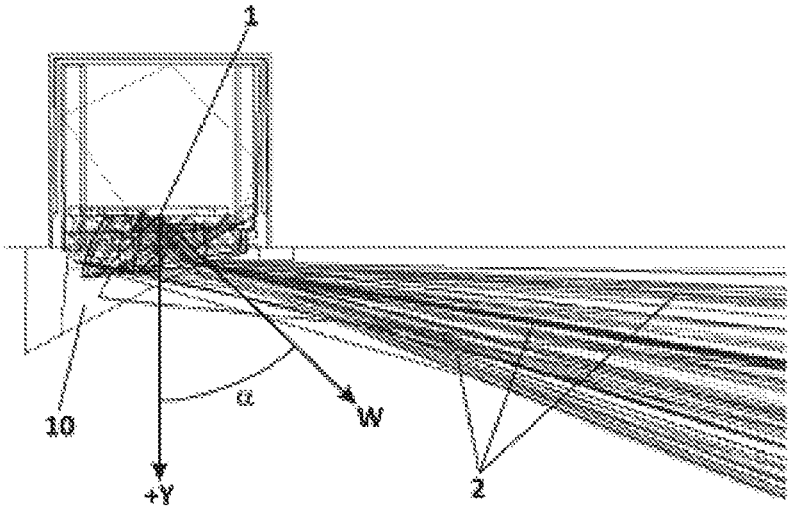
FIG. 1 shows a cross-sectional view of the optical device of the present invention wherein the distribution of the light rays emitted by the at least one light source as it passes through the lens has been represented.
Figure 2:
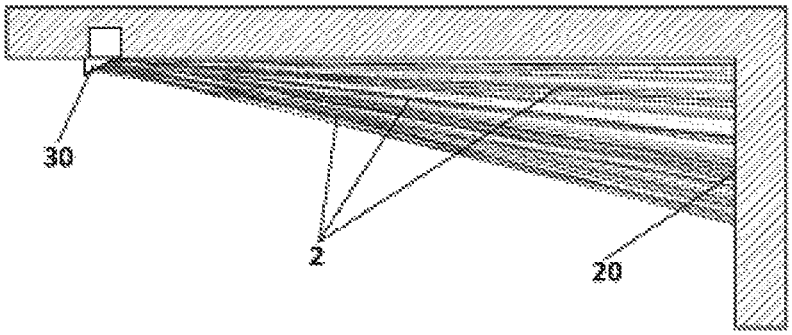
FIG. 2 shows a schematic view of the optical device of the present invention wherein the distribution of the light rays emitted by the at least one light source as it passes through the lens has been represented, which enables a predetermined area to be illuminated with a very high degree of uniformity in a plane essentially perpendicular to said optical device, in this case the predetermined area being a wall arranged at 0° from the ceiling of a room wherein the optical device is placed.
Figure 3:
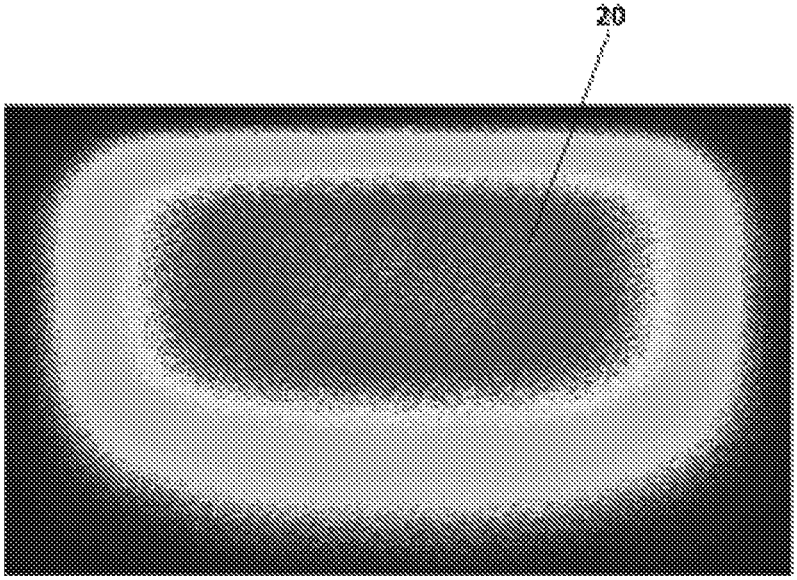
FIG. 3 shows a thermographic map wherein the predetermined area with a very high degree of uniformity and illuminated by the optical device of the present invention is observed in the centre.
Figure 4:
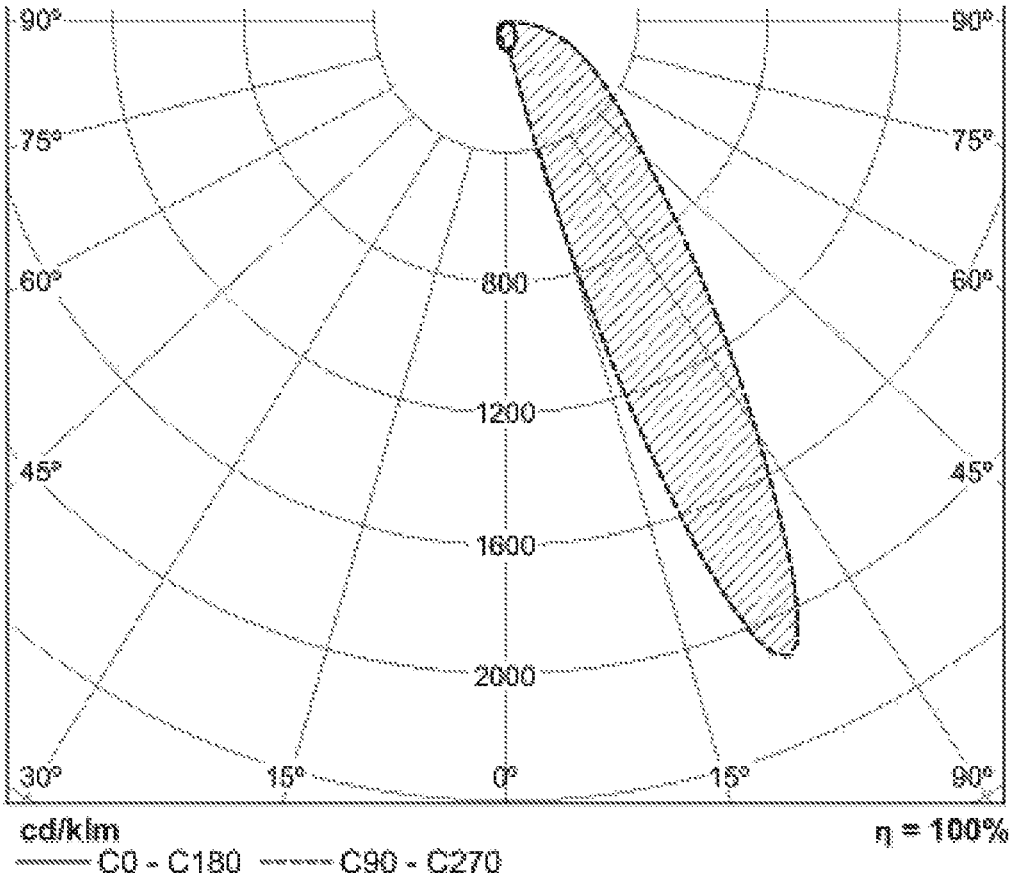
FIG. 4 shows the angular distribution of light intensity of the optical device of the present invention wherein it is observed that the light beam is below a cut-off angle of 75°.

The optical device of the present invention is described below in detail. The optical device, as shown in FIG. 1, comprises

- at least one light source (1) intended to radiate a light beam (2) in a first direction (W) that forms an angle (a) less than 90° with an essentially vertical downward direction (+Y);
- a lens (4) that in turn comprises:
  - a first total internal reflection surface (5) through which the light beam (2) is reflected; and
  - a second faceted surface (6) comprising at least one step (7, 17) defining at least one first section (8) and one second section (9) of said second faceted surface (6), wherein the second faceted surface (6) is configured to refract the light beam (2);
  - wherein the second faceted surface (6) forms at least an angle (β) greater than 90° or the conjugate thereof with the essentially vertical downward direction (+Y);
- a shielding device (10) defining therein an interior space wherein the lens (4) is at least partially confined.

Preferably, the light beam (2) is below a cut-off angle of 75°.

Figure 5:
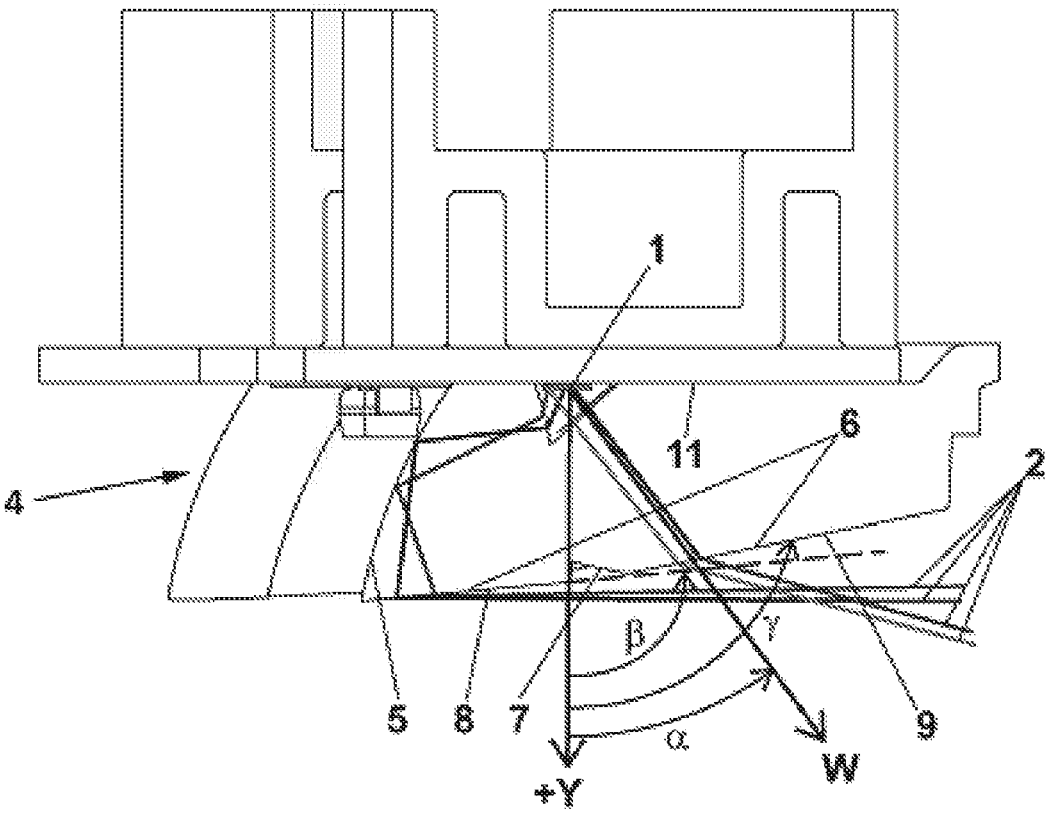
FIG. 5 shows a cross-sectional view of the optical device of the present invention according to a first preferred exemplary embodiment, wherein the shielding device has not been represented.

In a first preferred exemplary embodiment shown in FIG. 5, the second faceted surface (6) comprises a first step (7) defining a first section (8) of the second faceted surface (6) that forms a first angle (β) greater than 90° or the conjugate thereof with the essentially vertical downward direction (+Y), and a second section (9) of the second faceted surface (6) that forms a second angle (γ) greater than 90° or the conjugate thereof with the essentially vertical downward direction (+Y), wherein the first angle (β) is smaller than the second angle (γ) or the first angle (β) is greater than the second angle (γ) in the case of the conjugates.

Preferably, the first section (8) is further from the at least one light source (1) than the second section (9) in the essentially vertical downward direction (+Y).

Figure 6:
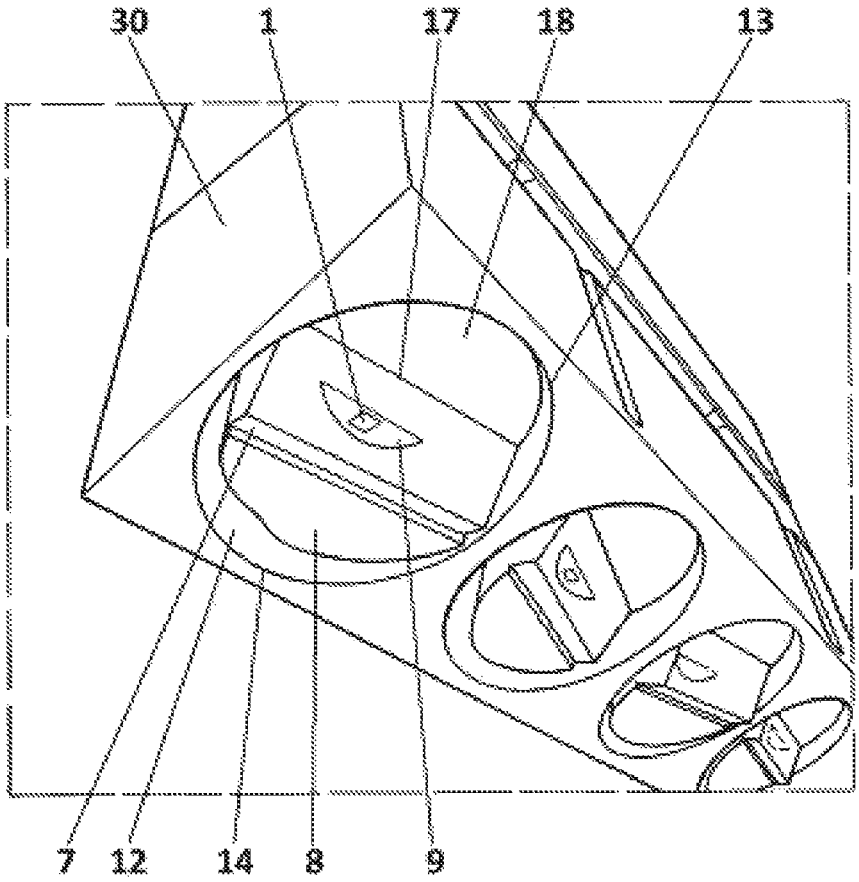
FIG. 6 shows a perspective view of a luminaire comprising an optical device of the present invention according to a second preferred exemplary embodiment of said device.

In a second preferred exemplary embodiment shown in FIG. 6, the second faceted surface (6) comprises a first step (7) defining a first section (8) of the second faceted surface (6) that forms a first angle (β) greater than 90° or the conjugate thereof with the essentially vertical downward direction (+Y), and a second section (9) of the second faceted surface (6) that forms a second angle (γ) greater than 90° or the conjugate thereof with the essentially vertical downward direction (+Y), wherein the first angle (β) is smaller than the second angle (γ) or the first angle (β) is greater than the second angle (γ) in the case of the conjugates. In this second preferred exemplary embodiment, the second faceted surface (6) further comprises a second step (17) defining a third section (18) of the second faceted surface (6) that forms a third angle (δ) greater than 90° or the conjugate thereof with the essentially vertical downward direction (+Y).

Preferably, the first section (8) is further from the at least one light source (1) than the second section (9), which in turn is further from the at least one light source (1) than the third section (18) in the essentially vertical downward direction (+Y).

Preferably, the first total internal reflection surface (5) and the second faceted surface (6) are essentially confined in the interior space defined by the shielding device (10), as shown in FIG. 6.

Preferably, the shielding device (10) has the shape of a truncated cylinder comprising a straight base (11) and a surface of revolution (12), wherein the axis of the truncated cylinder is essentially parallel to the essentially vertical downward direction (+Y) and wherein the straight base (11) and the surface of revolution (12) define the interior space defined by the shielding device (10), wherein the surface of revolution (12) comprises an ellipse-shaped free edge (13), wherein a point (14) of the ellipse arranged at a greater height in the essentially vertical downward direction (+Y) is the point furthest from a predetermined area (20) to be illuminated.

The at least one light source (1) and the lens (4) can rotate about an axis essentially parallel to the essentially vertical downward direction (+Y), with respect to the shielding device, such that it is possible to orient said at least one light source and said lens with respect to the shielding device.

This is observed in FIG. 6, wherein several lighting devices are shown according to the second preferred exemplary embodiment, oriented in a different way with respect to a housing (30) of a luminaire, which will be explained below.

The luminaire comprises at least one optical device of either of the two previously described exemplary embodiments and a housing (30) wherein a set of optical devices are arranged, preferably adjacently, wherein the housing (30) comprises holes that define the shielding devices (10) of each of the optical devices.

The invention claimed is:

1. An optical device comprising:

at least one light source intended to radiate a light beam in a first direction that forms an angle less than 90° with an essentially vertical downward direction;

a lens that in turn comprises:

a total internal reflection surface through which the light beam is reflected; and a faceted surface comprising at least one first step defining at least:

a first section; and a second section;

of said faceted surface, wherein the faceted surface is configured to refract the light beam; and wherein the faceted surface forms at least an angle greater than 90° or the conjugate thereof with the essentially vertical downward direction;

a shielding device defining therein an interior space wherein the lens is at least partially confined;

and wherein the shielding device has the shape of a truncated cylinder comprising a straight base and a surface of revolution, wherein the axis of the truncated cylinder is essentially parallel to the essentially vertical downward direction and wherein the straight base and the surface of revolution define the interior space defined by the shielding device.

2. The optical device of claim 1, wherein the first section of the faceted surface forms a first angle greater than 90° or the conjugate thereof with the essentially vertical downward direction, and the second section of the faceted surface forms a second angle greater than 90° or the conjugate thereof with the essentially vertical downward direction, wherein the first angle is smaller than the second angle or the first angle is greater than the second angle in the case of the conjugates.

3. The optical device of claim 2, wherein the first section is further from the at least one light source than the second section in the essentially vertical downward direction.

4. The optical device of claim 2, wherein the faceted surface further comprises a second step defining a third section of the faceted surface that forms a third angle greater than 90° or the conjugate thereof with the essentially vertical downward direction.

5. The optical device of claim 1, wherein the total internal reflection surface and the faceted surface are essentially confined in the interior space defined by the shielding device.

6. The optical device of claim 1, wherein the shielding device has the shape of a truncated cylinder comprising a straight base and a surface of revolution, wherein the axis of the truncated cylinder is essentially parallel to the essentially vertical downward direction and wherein the straight base and the surface of revolution define the interior space defined by the shielding device, wherein the surface of revolution comprises an ellipse-shaped free edge, wherein a point of the ellipse arranged at a greater height in the essentially vertical downward direction is the point furthest from a predetermined area to be illuminated.

7. The optical device of claim 1, the surface of revolution comprises an ellipse-shaped free edge, wherein a point of the ellipse arranged at a greater height in the essentially vertical downward direction is the point furthest from a predetermined area to be illuminated.

8. The optical device of claim 1, wherein the at least one light source and the lens can rotate about an axis essentially parallel to the essentially vertical downward direction, with respect to the shielding device.

9. The optical device of claim 1, wherein the light beam is below a cut-off angle of 75°.

10. A luminaire comprising at least the optical device of claim 1.

11. The luminaire of claim 10 further comprising a housing wherein the at least one optical device is arranged, wherein the housing in turn defines the shielding device.

12. The luminaire of claim 11 comprising a set of optical devices adjacently arranged in the housing, which in turn comprises holes that define the shielding devices of each of the optical devices.

* * * * *